US012624429B2

(12) United States Patent
Huang et al.

(10) Patent No.: US 12,624,429 B2
(45) Date of Patent: May 12, 2026

(54) STRONG AND DUCTILE MEDIUM MANGANESE STEEL AND METHOD OF MAKING

(71) Applicant: THE UNIVERSITY OF HONG KONG, Hong Kong (CN)

(72) Inventors: Mingxin Huang, Hong Kong (CN); Chengpeng Huang, Hong Kong (CN)

(73) Assignee: THE UNIVERSITY OF HONG KONG, Hong Kong (CN)

( * ) Notice: Subject to any disclaimer, the term of this patent is extended or adjusted under 35 U.S.C. 154(b) by 481 days.

(21) Appl. No.: 18/044,935

(22) PCT Filed: May 6, 2021

(86) PCT No.: PCT/CN2021/091837
§ 371 (c)(1),
(2) Date: Mar. 10, 2023

(87) PCT Pub. No.: WO2022/068201
PCT Pub. Date: Apr. 7, 2022

(65) Prior Publication Data

US 2023/0340650 A1 Oct. 26, 2023

Related U.S. Application Data

(60) Provisional application No. 63/086,813, filed on Oct. 2, 2020.

(51) Int. Cl.
*C22C 38/04* (2006.01)
*C21D 8/02* (2026.01)
(Continued)

(52) U.S. Cl.
CPC ..... *C22C 38/04* (2013.01); *C21D 8/0226* (2013.01); *C21D 8/0231* (2013.01);
(Continued)

(58) Field of Classification Search
None
See application file for complete search history.

(56) References Cited

FOREIGN PATENT DOCUMENTS

CN 104328360 A 2/2015
CN 104379791 A 2/2015
(Continued)

OTHER PUBLICATIONS

International Search Report and Written Opinion of corresponding International Application No. PCT/CN2021/091837, mailed Aug. 5, 2021.

*Primary Examiner* — Anthony M Liang
(74) *Attorney, Agent, or Firm* — Leason Ellis LLP

(57) ABSTRACT

An ultra-strong, ductile and cheap medium manganese steel comprises in percentage by mass: 8-12 wt. % Mn, 0.2-0.4 wt. % C, 1-3 wt. % Al, 0.05-0.39 wt. % V, and the balance of Fe. The manufacturing method of the ultra-strong and ductile medium manganese steel includes the steps of: (a) hot rolling an ingot at 900-1200° C. into a steel sheet (or plate, or bar); (b) air cooling or water quenching the steel sheet to room temperature or warm rolling temperature, (c) warm rolling the steel sheet at 350-750° C. with 30-60% thickness reduction; (d) air cooling or water quenched the steel sheet to room temperature; (e) annealing the steel sheet at 600-650° C. for 0-300 minutes and (f) air cooling or water quenched the sheet to room temperature.

9 Claims, 4 Drawing Sheets

(51) Int. Cl.

| | |
|---|---|
| ***C21D 8/0221*** | (2026.01) |
| ***C21D 8/0247*** | (2026.01) |
| ***C22C 38/06*** | (2006.01) |
| ***C22C 38/12*** | (2006.01) |

(52) U.S. Cl.
CPC ..... *C21D 8/0236* (2013.01); *C21D 8/0273* (2013.01); *C22C 38/06* (2013.01); *C22C 38/12* (2013.01); *C21D 2211/001* (2013.01); *C21D 2211/008* (2013.01)

(56) References Cited

FOREIGN PATENT DOCUMENTS

| | | | |
|---|---|---|---|
| CN | 104593675 | A | 5/2015 |
| CN | 105861933 | A | 8/2016 |
| CN | 109790611 | A | 5/2019 |
| EP | 2383353 | A2 | 11/2011 |
| WO | 2019134102 | A1 | 7/2019 |

STRONG AND DUCTILE MEDIUM MANGANESE STEEL AND METHOD OF MAKING

CROSS-REFERENCE TO RELATED PATENT APPLICATIONS

This application is a U.S. National Stage Application under 35 U.S.C. § 371 of International Patent Application No. PCT/CN2021/091837, filed May 6, 2021, and claims the benefit of priority under 35 U.S.C. Section 119 (e) of U.S. Application No. 63/086,813, filed Oct. 2, 2020, all of which are incorporated by reference in their entireties. The International Application was published on Apr. 7, 2022 as International Publication No. WO 2022/068201 A1.

FIELD OF THE INVENTION

The present invention relates generally to strong and ductile medium manganese steel and a method of producing the same, and more particularly to a super steel that has a lower cost and is easy to manufacture.

BACKGROUND OF THE INVENTION

Steels play a considerably important role in the fast development of modern industries like automotive, aviation, aerospace, shipbuilding, architecture and so on. Development of advanced steels with higher strengths and better ductility are a constant goal of scientists working in the field. Such steels are expected to help in the construction of a more energy-efficiently and more environment-friendly world. A steel with high strength supports more loading with equal mass of material. In other words, with the help of high strength steel, less material is needed to satisfy the same loading condition. This important property of high strength steel makes structures in our world much lighter. For example, an automobile comprises lots of steel, which accounts for more than half of its total weight. Using a high strength steel will make the car lighter and more energy-efficient, while still proving high safety in a car crash.

Besides high strength, high ductility is another important property of steel, which means it can experience a large deformation without immediate break down. A high ductile steel will also make vehicles and other structures much safer by avoiding catastrophic failure. On other hand, good ductility is also a benefit in processing and shaping of the steel to different shapes of components, for example stamping, rolling, extruding.

However, improving the strength and ductility of a steel simultaneously is usually very difficult. This is known as the strength-ductility tradeoff Many researchers have dedicated themselves to the development of advanced steel with high strength and good ductility, through a variety of methods. In the automotive industry there are generally three generations of advanced high strength steels (AHSS) that have been developed in the past several decades to make cars more light-weight, energy-efficient, low-cost and safe. The first generation of AHSS includes dual phase (DP) steels, transformation induced plasticity (TRIP) steels, complex phase (CP) steels, and martensitic (MART) steels. The product of strength and elongation of these steels is around 20,000 MPa %. The second generation of AHSS includes twinning induced plasticity (TWIP) steel with a product of strength and elongation around 60,000 MPa %, but with low yield strength and high manganese content, which can be expensive. The third generation of AHSS is now being developed, with a product of strength and elongation around 40,000 MPa %, but improved yield strength and a lower amount of manganese.

Medium content manganese steel, which contains 3 wt. % to 12 wt. % manganese, is an alternative way to realize the outstanding mechanical properties of the third generation AHSS. Currently some steel companies have developed types of medium manganese steel like Quench & Partitioning (Q&P) steel, which has a good balance of high strength and good ductility. The medium manganese steel is a promising steel for making super steel that breaks the strength-ductility tradeoff A few years ago, a group at the Hong Kong University developed a super steel with the chemical composition of 8-12 wt. % Mn, 0.38-0.54 wt. % C, 1.5-2.5 wt. % Al, 0.6-0.8 wt. % V and the balance of Fe preferably with the chemical composition 10 wt. % Mn, 0.47 wt. % C, 2 wt. % Al, 0.7 wt % V and the balance of Fe that shows high yield strength up to 2.2 GPa and large uniform elongation up to 16% at the same time. The details of this development can be found in PCT International Application No. WO2018035739A1. This super medium manganese steel with 0.7 wt. % V exhibits extraordinary mechanical performance but has a much lower price compared to other high strength steels like maraging steels.

Despite the exceptionable mechanical properties of this super steel, it does have some limitations. First, the process of making this steel involves many steps of rolling and annealing, which are very time consuming and inconvenient for industrial manufacture. Second, the properties of the steel are very sensitive to the temperature of the last annealing process, which is not easy to control during industrial manufacture. Third, the high content of C in this super steel causes it to have a very poor welding property, which restricts its application in many cases. Fourth, although this super steel is much lower priced than many other super steels, it is still more expensive than many other medium manganese steels like Q&P steel, due to its high V content (0.7 wt. %).

It is an object of the present invention to provide a way to further decease the price of super steel and reduce the overall processing time, but to do so in a way that does not harm its outstanding mechanical properties.

SUMMARY OF THE INVENTION

The present invention provides a type of strong and ductile medium manganese steel and a method for making this steel.

The ultra-strong, ductile and cheap medium manganese steel of the present invention comprises in percentage by mass: 8-12 wt. % Mn, 0.2-0.4 wt. % C, 1-3 wt. % Al, 0.05-0.39 wt. % V, and the balance of Fe. The manufacturing method of the ultra-strong and ductile medium manganese steel of the present invention includes the following steps: (a) hot rolling the ingot at 900-1200° C. into steel sheet (or plate, or bar); (b) air cooling or water quenching the steel sheet to room temperature or to the warm rolling temperature (350-750° C.), (c) warm rolling the steel sheet (or plate, or bar) at 350-750° C. with 30-60% thickness reduction; (d) air cooling or water quenching the steel sheet to room temperature; (e) annealing the steel sheet (or plate or bar) at 600-650° C. for 0-300 minutes and (f) air cooling or water quenched to room temperature.

By the process of the present invention a warm rolling (WR) steel sheet (or plate, or bar) is obtained. This WR steel sheet (or plate or bar) can serve as finial product, or as a transitional product that is subjected to the following additional processes of: (g) cold rolling (CR) the WR steel sheet (or plate, or bar) at room temperature with 10-35% thickness reduction, (h) annealing the resulting steel sheet (or plate, or bar) at 200-600° C. for 0-30 minutes and (i) air cooling or water quenching the steel sheet to room temperature. As a result of this further process another steel product is obtained that has gone through WR, CR and annealing. This WR steel product has an ultimate tensile strength (UTS) up to 1.6 GPa, and uniform elongation up to 15-33%. The WR+CR+annealing steel product has a yield strength up to 1.8-2.1 GPa, and uniform elongation up to 12-20%. Specially, for steels of present invention with low C and low V contents, two annealing processes can be removed without affecting the mechanical properties. The advantage of the method of the present invention is that it greatly reduces the processing time, e.g. by 50%, and it is very convenient for large-scale industrial manufacturing.

Specifically, compared to the previous patent for the super steel that has the chemical composition of 8-12 wt. % Mn, 0.38-0.54 wt. % C, 1.5-2.5 wt. % Al, 0.6-0.8 wt. % V and the balance of Fe, the present new steel has a much lower vanadium content and lower carbon content. A lower vanadium content can reduce the cost of the material while a lower carbon content can help to improve the welding property. The present new steel also allow for the elimination of the annealing and partitioning process of the prior art, which greatly reduces the processing time.

BRIEF DESCRIPTION OF THE DRAWINGS

The foregoing and other objects and advantages of the present invention will become more apparent when considered in connection with the following detailed description and appended drawings in which like designations denote like elements in the various views, and wherein.

DETAILED DESCRIPTION OF THE INVENTION

The present invention provides a super strong and ductile medium manganese steel comprising, by weight percentage: 8-12 wt. % Mn, 0.2-0.4 wt. % C, 1-3 wt. % Al, 0.05-0.39 wt. % V, and the balance of Fe. Two exemplary embodiments are demonstrated, which comprise or consist of, by weight percentage: 10 wt. % Mn, 0.2 wt. % C, 2 wt. % Al, 0.1 wt. % V, balance of Fe, and 10 wt. % Mn, 0.4 wt. % C, 2 wt. % Al, 0.3 wt. % V, balance of Fe, respectively.

In order to realize high strength and good ductility simultaneously in this medium manganese steel, the combination of warm rolling, cold rolling and annealing processes are used. The aim of the process of warm rolling is to increase dislocation density of retained austenite, making it more stable. The cold rolling will transform parts of the retained austenite to harder martensite and will also further improve the dislocation density of the martensite and retained austenite. The high dislocation density creates high strength for the steel. The transformed martensite will inherit the mobile dislocations in the retained austenite produced by warm rolling. The high mobile dislocations contribute to good ductility of the steel.

Figure 1:
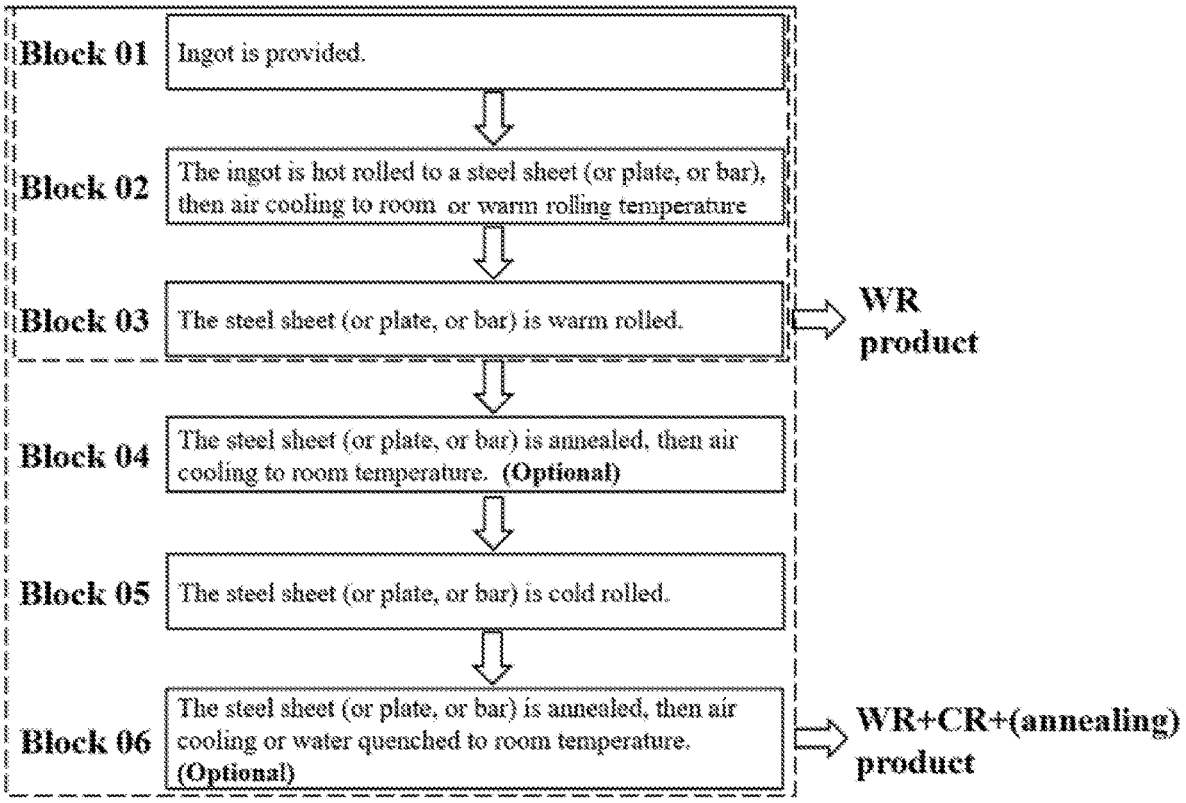
FIG. 1 is a flow chart of the method for manufacturing the super strong and ductile medium manganese steel of the present invention.
Figure 2:
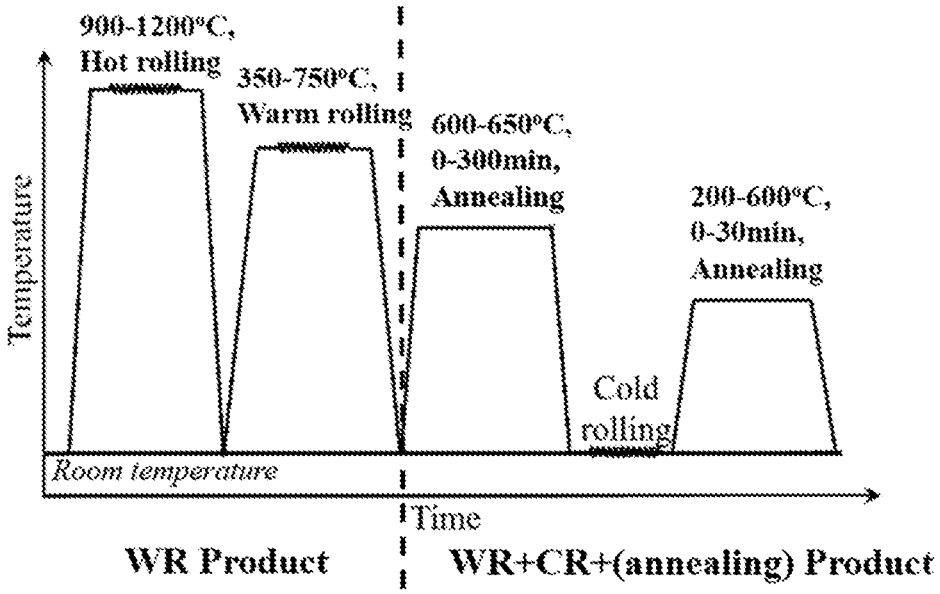
FIG. 2 is a schematic illustration of the temperature-mechanical processing steps of the present invention.

FIG. 1 and FIG. 2 show the detailed thermo-mechanical routine for manufacturing this strong and ductile medium manganese steel. The process for making super strong and ductile steel according the present invention begins at step or Block 01 in FIG. 1 where the ingot is provided. The ingot comprises, by weight percentage: 8-12 wt. % Mn, 0.2-0.4 wt. % C, 1-3 wt. % Al, 0.05-0.39 wt. % V, and the balance of Fe.

In step or Block 02, the ingot is hot rolled to produce a thick steel sheet (or plate, or bar). Then the hot rolled steel sheet (or plate, or bar) is air cool or water cool to room temperature or the warm rolling temperature. Note that, the starting temperature of the hot rolling is about 1200-1300° C., and the ending temperature of the hot rolling is about 900-1000° C. In the two exemplary embodiments, the ingots were hot rolled to a final thickness of 4 mm. The hot rolling entry and exit temperature were 1200° C. and 900° C., respectively.

In Block 03, the hot rolled sheet (or plate, or bar) is warm rolled at a temperature of 350-750° C. with a thickness reduction of 30-60%. After this warm rolling (WR) process is finished, the WR product is obtained, which product has very high ultimate tensile strength (UTS) and very good ductility. This warm rolling step is very important for producing this strong and ductile medium manganese steel. The warm rolling increases the dislocation density of retained austenite, which will make the austenite more stable. Thus, more austenite will be retained after cooling to room temperature. For the WR product, the retained austenite will gradually transform to martensite during the tensile test at room temperature, known as the transformation induced plasticity (TRIP) effect. The TRIP effect will greatly improve the strain hardening and elongation of the steel, making this steel strong and ductile simultaneously.

The following steps are based on the WR product and are directed to making a WR+CR+(annealing) product that has very high yield strength and very good ductility simultaneously.

Block 04 is an annealing process. This annealing process is optional depending on the chemical composition. For exemplary embodiments with chemical compositions of 10 wt. % Mn, 0.2 wt. % C, 2 wt. % Al, 0.1 wt. % V, and balance of Fe, the annealing process is not necessary. For exemplary embodiments with chemical compositions of 10 wt. % Mn, 0.4 wt. % C, 2 wt. % Al, 0.3 wt. % V, and balance of Fe, the annealing process is necessary. The main purpose of this annealing process is to decrease the dislocation density a little so that the steel product will not crack when the cold rolling process in Block 05 is performed.

In Block 05, the steel sheet (or plate, or bar) is cold rolled with a thickness reduction of 10-35%. During the cold rolling process, part of the retained austenite in the WR product will be transformed to hard martensite. The transformed martensite will inherit the mobile dislocations in the retained austenite produced by the warm rolling. Thus, the final WR+CR product consists of a hard martensite matrix and retained austenite. The high dislocation density in both martensite and austenite make the yielding strength extremely high. What is more, the high mobile dislocations produced by the WR also make the steel very ductile.

Block 06 is another annealing process. This annealing process is also optional depending on the chemical composition. For exemplary embodiments with chemical compositions of 10 wt. % Mn, 0.2 wt. % C, 2 wt. % Al, 0.1 wt. % V, and balance of Fe, the annealing process is not necessary. For exemplary embodiments with chemical compositions of 10 wt. % Mn, 0.4 wt. % C, 2 wt. % Al, 0.3 wt. % V, and balance of Fe, the annealing process is necessary. The main purpose of this annealing process is to reduce residual stress and partition carbon from martensite to retained austenite, which will make the martensite matrix less brittle, and the retained austenite more stable.

Figure 3A:
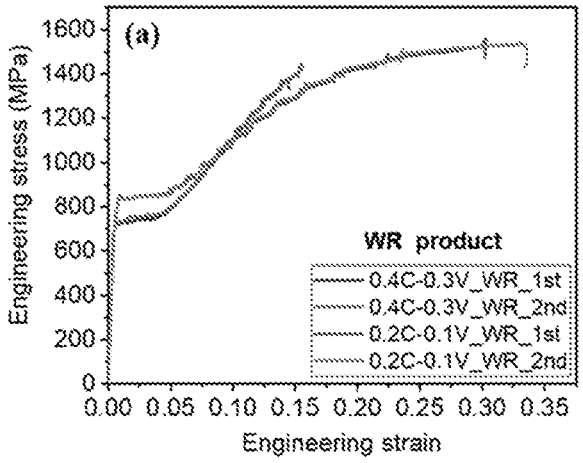
FIG. 3A shows room temperature and quasi-static strain rate tensile testing results for WR products according two exemplary embodiments of the present invention.
Figure 3B:
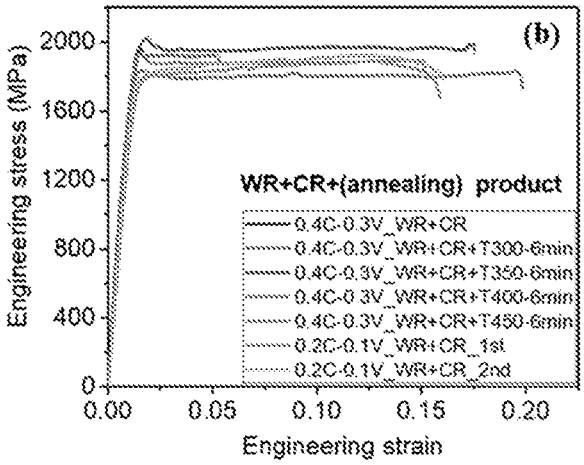
FIG. 3B shows room temperature and quasi-static strain rate the tensile testing results for WR+CR+(annealing) products according two exemplary embodiments of the present invention.

In a test, after the WR and WR+CR+(annealing) products were produced successfully, the tensile samples were wire cut from the steel product with the tensile axis aligned parallel to the roll direction. Then uniaxial quasi-static tensile tests were carried out at room temperature. FIGS. 3A and 3B show the tensile results of WR and WR+CR+(annealing) samples of two exemplary embodiments of the present invention, respectively. The WR sample has a high ultimate tensile strength (UTS) up to 1.6 GPa, and good uniform elongation up to 15-33%. The WR+CR+(annealing) steel product has a super high yield strength up to 1.8-2.1 GPa, and good uniform elongation up to 12-20%.

Specifically, in FIG. 3A the chemical compositions of these two illustrative examples are Fe-10Mn-0.2C-2Al-0.1V (wt. %) and Fe-10Mn-0.4C-2A1-0.3V (wt. %), respectively. Two repetitive tests are performed for each case. In FIG. 3B specifically, the chemical compositions of these two illustrative examples are Fe-10Mn-0.2C-2Al-0.1V (wt. %) and Fe-10Mn-0.4C-2A1-0.3V (wt. %), respectively. For the Fe-10Mn-0.2C-2A1-0.1V (wt. %) steel samples, no annealing processes were need. Two repetitive tests are performed. For the Fe-10Mn-0.4C-2A1-0.3V (wt. %) steel samples, annealing was a necessary step and could not be avoided. Tests with different annealing temperatures were performed.

Figure 4A:
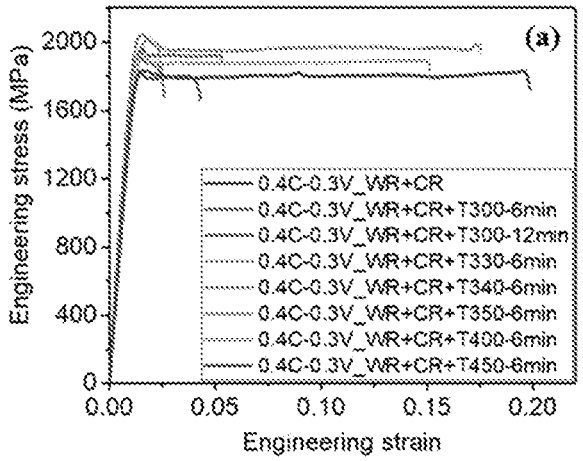
FIG. 4A shows room temperature and quasi-static strain rate tensile testing results for WR+CR+annealing products of an exemplary embodiment with a chemical composition of Fe-10Mn-0.4C-2A1-0.3V (wt. %)
Figure 4B:
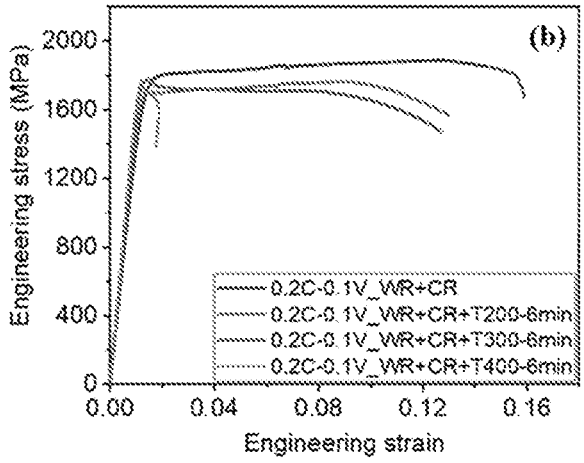
FIG. 4B shows room temperature and quasi-static strain rate tensile testing results for WR+CR+annealing products of exemplary embodiment with a chemical composition of Fe-10Mn-0.2C-2A1-0.1V (wt. %)

FIGS. 4A and 4B show the tensile testing results for WR+CR+annealing products of exemplary embodiments with a chemical composition of Fe-10Mn-0.4C-2A1-0.3V (wt. %) and a composition of Fe-10Mn-0.2C-2Al-0.1V (wt. %), respectively. Note that for the sample comprising Fe-10Mn-0.4C-2Al-0.3V (wt. %), the steel exhibits good ductility, with a 15%-20% uniform elongation, only when the annealing temperature varies from 350-450° C. However, for the sample comprising Fe-10Mn-0.2C-2Al-0.1V (wt. %), the best mechanical property is achieved without any annealing.

For the tests shown in FIG. 4A the annealing temperature varies from 300-450° C. From FIG. 4A it is obvious that the sample without annealing is quit brittle, breaking down immediately after yielding, with no elongation at all. The ductility of the steel is quite sensitive to the annealing temperature. When the annealing temperature varies from 350-450° C., the steel exhibits good ductility, with a 15%-20% uniform elongation.

For the tests shown in FIG. 4B a different steel is used than the steel of FIG. 4A and it has a chemical composition of Fe-10Mn-0.2C-2Al-0.1V (wt. %). This steel shows the best mechanical properties without an annealing process. The higher the annealing temperature is, the worse the mechanical property become.

Figure 5A:
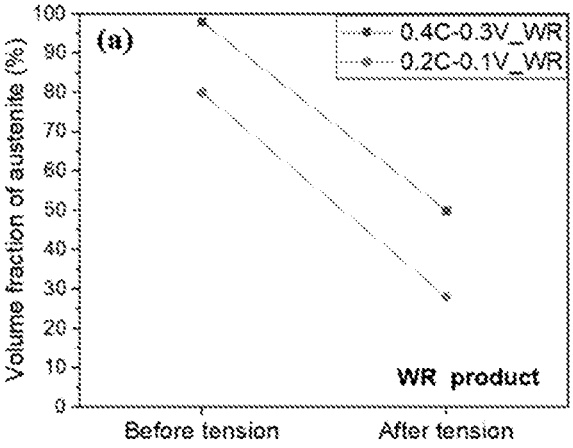
FIG. 5A shows the evolution of volume fraction of austenite of WR products according two exemplary embodiments of the present invention.

FIG. 5A shows the evolution of volume fraction of austenite of WR samples according two exemplary embodiments of the present invention, respectively. Specifically, the chemical compositions of these two illustrative examples are Fe-10Mn-0.2C-2Al-0.1V (wt. %) and Fe-10Mn-0.4C-2A1-0.3V (wt. %), respectively. For WR samples, the volume fraction of austenite before tensile test is about 80%-98% and decreases to 28%-50% after tensile testing because of the TRIP effect. For WR+CR+(annealing) samples, the volume fraction of austenite before tensile testing is about 40%-52% and decreases to 27%-42% because of the TRIP effect.

Figure 5B:
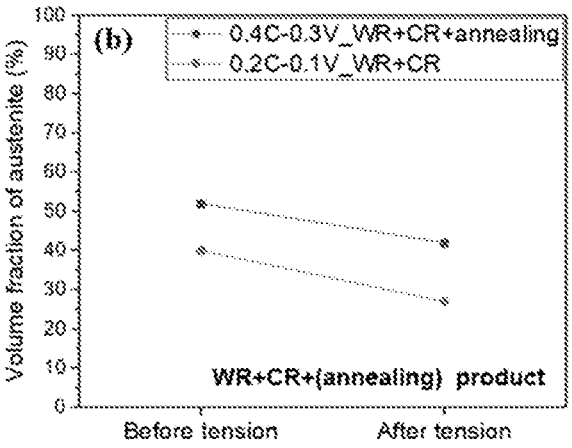
FIG. 5B shows the evolution of volume fraction of austenite of WR+CR+(annealing) products according two exemplary embodiments of the present invention.

FIG. 5B shows the evolution of volume fraction of austenite of WR+CR+(annealing) samples or products according two exemplary embodiments of the present invention. Specifically, the chemical compositions of these two illustrative examples are Fe-10Mn-0.2C-2A1-0.1V (wt. %) and Fe-10Mn-0.4C-2Al-0.3V (wt. %), respectively.

The foregoing principles can further be illustrated. In particular, an illustrative embodiment of this strong and ductile medium manganese steel comprises the following chemical compositions in percentage by weight: 8-12 wt. % Mn, 0.2-0.4 wt. % C, 1-3 wt. % Al, 0.05-0.39 wt. % V, and the balance of Fe. In another embodiment of this medium manganese steel according to the present invention, the content of C is lower than 0.4 wt. % and/or the content of V is lower than 0.39 wt. %.

In order to solve the problems of super steel that mentioned before, the present super strong and ductile medium manganese steel is made with low carbon and low vanadium content, comprising 0.15-0.4 wt. % C, 0.05-0.39 wt. % V. The low content of C will greatly improve the welding property of this super steel, and the low content of V will further decrease the total price of this steel.

An illustrative method for producing the present super strong and ductile medium manganese steel includes the following steps:

(a) Providing ingots comprised of 8-12 wt. % Mn, 0.2-0.4 wt. % C, 1-3 wt. % Al, 0.05-0.39 wt. % V, and the balance of Fe;

(b) Hot rolling of the ingot at 900-1200° C. to produce a thick steel sheet (or plate, or bar);

(c) Air cooling the steel sheet (or plate, or bar) to room temperature or warm rolling temperature;

(d) Warm rolling the steel sheet (or plate, or bar) at 350-750° C. with 30-60% thickness reduction. This step is very crucial and is aimed to increase dislocation density of retained austenite, making it more stable.

(e) Air cooling the steel sheet (or plate, or bar) to room temperature;

With this process a warm rolling (WR) steel product is obtained. This WR steel product has very good mechanical property, with an ultimate tensile strength (UTS) up to 1.6 GPa, and uniform elongation up to 15-33%. Hence, this WR steel sheet (or plate, or bar) can serve as one type of finial product.

The WR steel sheet (or plate, or bar) could also serve as a transitional product that subject to following processes:

(f) Annealing the steel sheet (or plate, or bar) at 600-650° C. for 0-300 minutes;

(g) Air cooling the steel sheet (or plate, or bar) to room temperature;

(h) Cold rolling (CR) the WR steel sheet (or plate, or bar) at room temperature with 10-35% thickness reduction. This CR step will transform parts of retained austenite to harder martensite and will also further improve the dislocation density of martensite and retained austenite, which generate the high yield strength of the steel.

(i) Annealing the steel sheet (or plate, or bar) at 200-600° C. for 0-30 minutes;

(j) Air cooling or water quenched the steel sheet (or plate, or bar) to room temperature.

With this process another steel product is obtained that has gone through WR, CR and annealing. The WR+CR+annealing steel product has a super high yield strength up to 1.8-2.1 GPa, and good uniform elongation up to 12-20%.

In the WR product, before the tensile test the volume fraction of martensite is 0-20%, and the volume fraction of austenite is 80-100%. After the tensile test the volume fraction of austenite test is 28-53%, and the volume fraction of martensite is 47-72%.

In the WR+CR+(annealing) product, before the tensile test, the volume fraction of austenite test is 40-55%, and the volume fraction of martensite is 45-60%. After the tensile test, the volume fraction of austenite test is 27-44%, and the volume fraction of martensite is 56-73%.

As an example, a super strong and ductile medium manganese steel which comprises 10 wt. % Mn, 0.2 wt. % C, 2 wt. % Al, 0.1 wt. % V, and the balance of Fe, is produced following the aforementioned method. Note that this super medium manganese steel with this chemical composition will not need an annealing process. In other words, steps (f)(g) and (i)(j) will not be need. This great improvement in this steel will greatly simplify the total manufacture process and make it easy for industrial manufacture. The WR product has a very high ultimate tensile strength (UTS) up to 1.6 GPa, and a very long uniform elongation up to 33%. The WR+CR product has a super high yield strength up to 1.8 GPa, and good uniform elongation up to 14%.

For this super medium manganese steel with a chemical composition of 10 wt. % Mn, 0.2 wt. % C, 2 wt. % Al, 0.1 wt. % V, and the balance of Fe, in the WR product, has before a tensile test, a volume fraction of austenite of 80% and a volume fraction of martensite of 20%. After the tensile test, the volume fraction of austenite test is 28%, and the volume fraction of martensite is 72%. In the WR+CR product, before the tensile test, the volume fraction of austenite test is 40% and the volume fraction of martensite is 60%. After the tensile test the volume fraction of austenite test is 27%, and the volume fraction of martensite is 73%.

As an example, a super strong and ductile medium manganese steel comprises 10 wt. % Mn, 0.4 wt. % C, 2 wt. % Al, 0.3 wt. % V, and the balance of Fe, is produced following the aforementioned method. Note that for this super medium manganese steel with this chemical composition, two annealing processes are necessary and cannot be avoided. The WR product has a very high ultimate tensile strength (UTS) up to 1.5 GPa, and a long uniform elongation up to 16%. The WR+CR+annealing product has a super high yield strength up to 2.0 GPa, and good uniform elongation up to 20%.

For this super medium manganese steel with this chemical composition of 10 wt. % Mn, 0.4 wt. % C, 2 wt. % Al, 0.3 wt. % V, and the balance of Fe, in the WR product, before the tensile test, the volume fraction of austenite test is 0-5%, and the volume fraction of martensite is 95-100%. After the tensile test, the volume fraction of austenite is 47-53%, and the volume fraction of martensite is 47-53%. In the WR+CR+annealing product, before the tensile test, the volume fraction of austenite test is 50-55%, and the volume fraction of martensite is 45-50%. After the tensile test, the volume fraction of austenite test is 40-44% and the volume fraction of martensite is 56-60%.

As can be seen, retained austenite, TRIP effect and dislocation density are three important factors in the mechanical property of medium manganese steel. The strong and ductile medium manganese steel according to the present invention is therefore produced by controlling the volume fraction of retained austenite, TRIP effect and high dislocation density through warm rolling, cold rolling and annealing.

While the present invention has been particularly shown and described with reference to preferred embodiments thereof; it will be understood by those skilled in the art that various changes in form and details may be made therein without departing from the spirit and scope of the invention, and that the embodiments are merely illustrative of the invention, which is limited only by the appended claims. In particular, the foregoing detailed description illustrates the invention by way of example and not by way of limitation. The description enables one skilled in the art to make and use the present invention, and describes several embodiments, adaptations, variations, and method of uses of the present invention.

What is claimed is:

1. A method for manufacturing warm roll (WR) medium manganese steel, comprising the steps of:

(a) providing ingot comprised of 8-12 wt. % Mn, 0.2-0.4 wt. % C, 1-3 wt. % Al, 0.05-0.39 wt. % V, and the balance of Fe;

(b) hot rolling the ingot at 900-1200° C. to a thick steel product;

(c) air cooling the steel sheet or plate, or bar to room temperature or warm rolling temperature;

(d) warm rolling the steel product at 350-750° C. with 30-60% thickness reduction; and (e) air cooling the steel product to room temperature.

2. The method of claim 1, wherein in the hot rolling step a starting hot rolling temperature is 1200° C. and a finishing temperature is higher than 900° C., and wherein in the warm rolling step a starting warm rolling temperature is 750° C. and a finishing temperature is higher than 350° C.

3. The method of claim 1, wherein the ingot comprises 10 wt. % Mn, 0.2 wt. % C, 2 wt. % Al, 0.1 wt. % V, and the balance of Fe;

wherein the WR medium manganese steel has an ultimate tensile strength (UTS) up to 1.6 GPa, and uniform elongation up to 33%; and wherein the WR medium manganese steel has a volume fraction of austenite before tensile test of 80% and a volume fraction of martensite is 20%, and after tensile test the volume fraction of austenite is 28% and the volume fraction of martensite is 72%.

4. The method of claim 1, wherein the ingot comprises 10 wt. % Mn, 0.4 wt. % C, 2 wt. % Al, 0.3 wt. % V, and the balance of Fe;

wherein the WR medium manganese steel has an ultimate tensile strength (UTS) up to 1.5 GPa, and a uniform elongation up to 16%; and wherein the WR medium manganese steel has a volume fraction of austenite of 0-5% and a volume fraction of martensite of 95-100%, and after tensile test the volume fraction of austenite is 47-53% and the volume fraction of martensite is 47-53%.

5. A method for manufacturing WR+CR+(annealing) medium manganese steel, comprising the steps of:

manufacturing WR medium manganese steel according to the method of claim 4 and further including the steps of:

(f) optionally annealing the steel product at 600-650° C. for 0-300 minutes;

(g) optionally air cooling the steel product to room temperature;

(h) cold rolling (CR) the WR steel product at room temperature with 10-35% thickness reduction;

(i) optionally annealing the steel product at 200-600° C. for 0-30 minutes; and (j) optionally air cooling or water quenched the steel product to room temperature.

6. The method of claim 5, wherein in the hot rolling step a starting hot rolling temperature is 1200° C. and a finishing temperature is higher than 900° C.; and wherein in the warm rolling step a starting warm rolling temperature is 750° C., and a finishing temperature is higher than 350° C.

7. The method of claim 5, wherein the ingot comprises 10 wt. % Mn, 0.2 wt. % C, 2 wt. % Al, 0.1 wt. % V, and the balance of Fe;

wherein the steps (f) (g) (i) (j) can be deleted so the annealing time is 0 min;

wherein the WR+CR medium manganese steel product has a super high yield strength up to 1.8 GPa, and good uniform elongation up to 14%; and wherein the WR+CR medium manganese steel product has a volume fraction of austenite before tensile test of 40% and a volume fraction of martensite is 60%, and after tensile test the volume fraction of austenite is 27% and the volume fraction of martensite is 73%.

8. The method of claim 5, wherein the ingot comprises 10 wt. % Mn, 0.4 wt. % C, 2 wt. % Al, 0.3 wt. % V, and the balance of Fe;

wherein the step (f) of annealing the steel product is at 620° C. for 300 minutes;

wherein the step (i) of annealing the steel product is at 350-450° C. for 6 minutes;

wherein the WR+CR+annealing medium manganese steel product has a super high yield strength up to 2.0 GPa, and good uniform elongation up to 20%; and wherein the WR+CR+annealing medium manganese steel product has a volume fraction of austenite before a tensile test of 50-55% and a volume fraction of martensite of 45-50% and after tensile test, the volume fraction of austenite test is 40-44% and the volume fraction of martensite is 56-60%.

9. The method of claim 1, wherein the thick steel product is at least one of a sheet, plate, or bar.

* * * * *